United States Patent [19]

Lloyd, Jr. et al.

[11] Patent Number: 4,794,376

[45] Date of Patent: Dec. 27, 1988

[54] AUTOMATIC SIGNAL EVALUATION AND TRANSFER

[75] Inventors: Alva B. Lloyd, Jr.; Kenneth Schroeder, both of Lynchburg, Va.

[73] Assignee: The Babcock & Wilcox Company, New Orleans, La.

[21] Appl. No.: 149,347

[22] Filed: Jan. 28, 1988

[51] Int. Cl.[4] ..... G08B 29/00

[52] U.S. Cl. ..... 340/508; 340/507

[58] Field of Search ..... 340/540, 508, 507, 516; 364/184–187

[56] References Cited

U.S. PATENT DOCUMENTS 4,346,371 8/1982 Ida ..... 340/507

4,414,540 11/1983 Dickenson ..... 340/508

*Primary Examiner*—Glen R. Swann, III

*Assistant Examiner*—Thomas J. Mullen, Jr.

*Attorney, Agent, or Firm*—Vytas R. Matas; Robert J. Edwards

[57] ABSTRACT

An improved process measurement system is disclosed which provides automatic signal evaluation and transfer in connection with redundant signals generated from a common data source over two input channels and one output channel. The two input channels are monitored by a series of three comparators which compare real time values of the signals on the two channels, and as well, a real time and delay value from each channel.

4 Claims, 1 Drawing Sheet

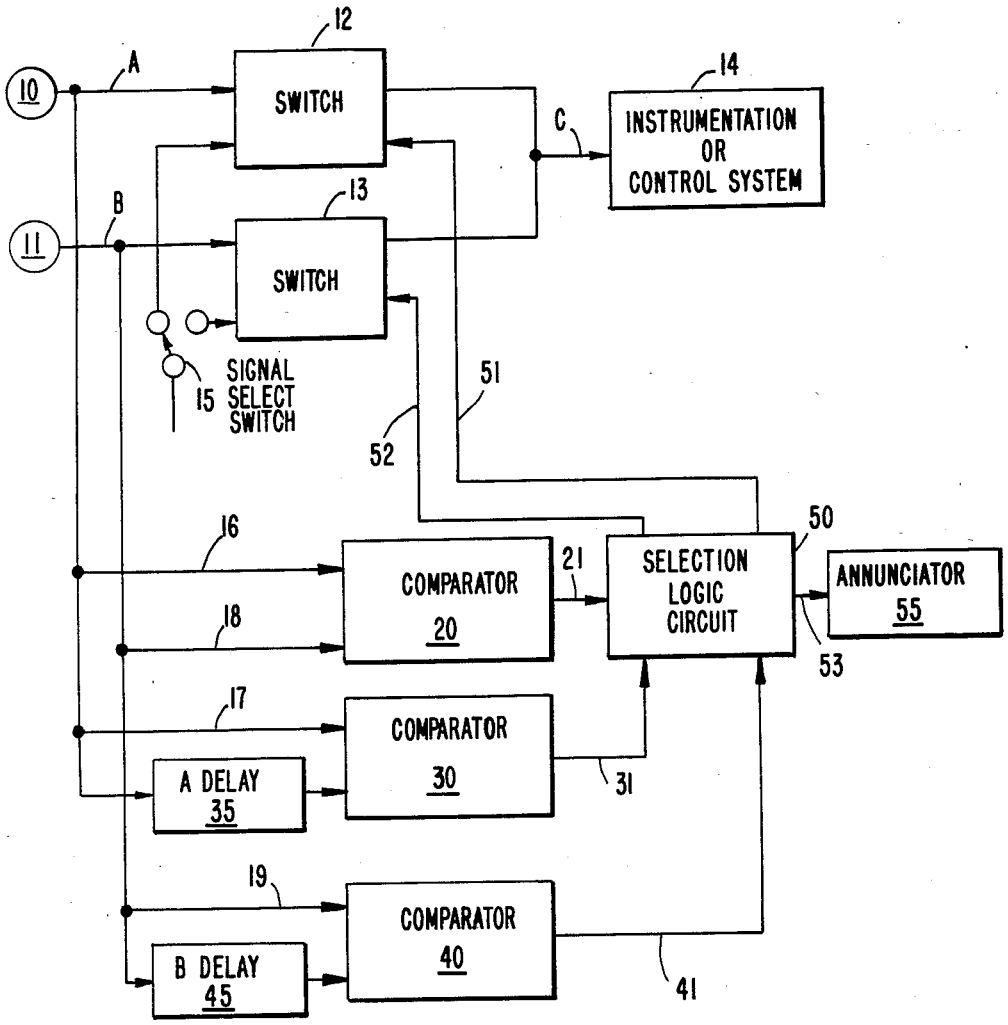
12
A
10
SWITCH
14
C
INSTRUMENTATION
OR
CONTROL SYSTEM
13
B
11
SWITCH
15
SIGNAL
SELECT
SWITCH
51
52
50
16
COMPARATOR
20
21
SELECTION
LOGIC
CIRCUIT
ANNUNCIATOR
55
18
53
17
COMPARATOR
30
A DELAY
35
31
19
COMPARATOR
40
B DELAY
45
41

AUTOMATIC SIGNAL EVALUATION AND TRANSFER

BACKGROUND

This invention relates to a system for automatically evaluating redundant process measurements and, more particularly, to an improved system for automatically detecting a signal fault among redundant signals and selecting an alternate accurate signal automatically from the redundant signals.

Single channel instrumentation and control systems can accommodate a single variable signal input. Often, two input signals, either of which can be manually selected, are provided. In the event of a signal failure, the recognition and reaction time to the failure must be sufficient to avoid serious system upsets.

In some process applications, each process parameter is monitored by two sensors to increase signal availability and to provide redundancy. Manual switching allows selection of either signal as an input to instrumentation and control system. However, automatic detection of a failed signal can be difficult to achieve. Since both sensors are monitoring the same process parameter, normally, both would indicate the same value. When one fails, however, each indicates a different value. In some cases, it is impossible to ascertain which failed without an additional standard against which the signals can be evaluated. Particularly, when the failure is a result of signal drift, i.e., drifting of the faulted signal slowly away from the correct value.

SUMMARY OF THE INVENTION

The invention is directed to an improved process measurement system for automatically detecting signal failures among redundant signals.

In particular, the invention is directed to improvements in a process measurement system of the type having a process data source, first and second signal generator means each operatively connected to the data source for generating first and second redundant signals of the same process data, respectively, and in which a first input channel and a second input channel are respectively connected to the first and second signal generator means, with one output channel provided, and with switch means operatively connected between the two output channels and the an output channel for selectively connecting one of the input channels to the output channel.

The improved system, in accordance with the invention, includes a first comparator, a second comparator and a third comparator. Means are provided for transmitting the first and second redundant signals to the first comparator from the data source. The first comparator includes means for comparing the first and second redundant signals for detecting whether the redundant signals fall within a first predetermined acceptance band and generating a first fault signal when at least one of the redundant signals falls outside of the first acceptance band. Selection logic means are connected to the first comparator for generating an indicating signal responsive to the first fault signal.

The second comparator is connected directly to the first redundant signal transmitting means. A first delay is operatively interconnected between the first redundant signal transmitting means and the second comparator for generating a delayed first redundant signal. The second comparator includes means for comparing the first redundant signal with the delayed first redundant signal for detecting whether the first redundant signal and delayed first redundant signal fall within a second predetermined acceptance band and generating a second fault signal when at least one of the first redundant signal and the delayed first redundant signal falls outside of the second acceptance band. The selection logic means is connected to the second comparator and includes means for generating a first signal switching signal responsive to the second fault signal.

The third comparator is connected directly to the second redundant signal transmitting means. A second delay is interconnected between the second redundant signal transmitting means and a third comparator for generating a delayed second redundant signal. The third comparator includes means for comparing the second redundant signal and the delayed second redundant signal for detecting whether the second redundant signal and the delayed second redundant signal fall within a third predetermined acceptance band and for generating a third fault signal when at least one of the second redundant signal and the delayed second redundant signal falls outside of the third acceptance band. The selection logic means is also operatively connected to the third comparator and includes means for generating a second signal switching signal responsive to the third fault signal.

In accordance with a preferred embodiment of the invention, the selection logic means is operable to operate the switch means responsive to combinations of the first and third fault signals and the first and second fault signals. More particularly, the selection logic means automatically operates the switch means to connect and lock the first input channel to the output channel responsive to the receipt of a first fault signal and a third fault signal. The selection logic means is also operable to connect and lock the second input channel to the output channel responsive to the receipt of a first fault signal and a second fault signal.

The various signals can be connected to annunciator means to provide an alarms to alert operators to various conditions that may occur.

BRIEF DESCRIPTION OF THE DRAWING

The sole FIGURE is a block diagram showing the basic elements of the improved process measurement system according to the invention.

DETAILED DESCRIPTION

The sole FIGURE diagramatically illustrates a preferred embodiment of a process measurement system according to the invention. The system includes two sensors 10, 11 for detecting process parameter in a process system in a well-known manner. The sensors are connected to two input channels A, B which are respectively connected to switches 12, 13 which in turn are connected to a single output channel C that is connected to an instrumentation or control system 14.

A signal selection switch 15 is operatively connected to the switches 12 and 13 and operable to selectively connect one of the input channels to the output channel.

Channel A includes an input line 16 directly connected to a first comparator 20 and an input line 17 directly connected to a second comparator 30. Channel B includes an input line 18 directly connected to the first comparator 20 and directly connected to a third comparator 40.

In addition, a delay 35 is interconnected between the first channel A and comparator 30 and a delay 45 is interconnected between the second channel B and the third comparator 40. The outputs 21, 31 and 41 of each of the comparators are connected to a selection logic circuit 50. The selection logic circuit 50 includes output lines 51, 52 which are connected to the switches 12 and 13. The selection logic circuit also includes an output 53 which is connected to an annunciator 55.

In operation, identical process inputs are received by sensors 10 and 11 and are fed to comparator 20 via input lines 16 and 18. Comparator 20 includes an acceptance band. If the value of the signals received from channels A and B are equal within the limits of the acceptance band, both are judged to be good and no output signal is generated. The selection logic circuit, under such circumstances, will allow normal manual selection of the signals by means of the signal selection switch 15. If the signals received from channels A and B by comparator 20 do not fall within the limits of the acceptance band, this indicates that one of the signals is faulted. Accordingly, the comparator 20 generates a first fault signal which is transmitted via line 21 to the selection logic circuit 50.

The selection logic circuit 50 includes means for generating an indicating signal responsive to the first fault signal. In a preferred embodiment, the annunciator 55 is operative to provide an audible type of alarm responsive to the indicating signal which is indicative of the first fault signal.

Delay 35 provides comparative 30 with a delayed version of the signal received from input channel A. The degree of delay can be set as appropriate for the nature of the signal being monitored. Second comparator 30 compares the first redundant signal received directly from channel A and the delayed first redundant signal received from delay 35 to determine whether the first redundant signal and the delayed first redundant signal fall within a predetermined second acceptance band. A second fault signal is generated by second comparator 30 when at least one of the first redundant signal and delayed first redundant signal falls outside of the second acceptance band. The selection logic circuit 50 is operative to generate a first signal switching signal responsive to the second fault signal.

Third comparator 40 receives a second redundant signal directly from channel B via input line 19 and a delayed second redundant signal which is generated in delay 45. The third comparator 40 compares the second redundant signal and the delayed second redundant signal for detecting whether the second redundant signal and the delayed second redundant signal fall within a predetermined third acceptance band. Comparator 40 generates a third fault signal when at least one of the second redundant signal an the delayed second redundant signal fall outside of the third acceptance band. The selection logic circuit 50 is operatively connected to the third comparator 40 and includes means for generating a second signal switching means responsive to the third fault signal.

In the improved system, according to the invention, the selection logic circuit 50 is operable to operate the signal select switch 15 to connect and lock the first input channel A to the output channel C responsive to receipt of a first fault signal and a third fault signal. Similarly, the selection logic circuit 50 is operable to operate the signal select switch 15 to connect and lock the second input channel B to the output channel C responsive to receipt of a first fault signal and a second fault signal.

Two types of signal failures can be expected and accommodated by the improved system according to the invention. The first type of fault signal to be expected can be characterized as a signal fault in which the faulted signal will change rapidly due to a circuit or component failure. The second type of signal fault which can be expected can be characterized as signal drift, i.e., wherein the faulted signal will slowly drift away from correct values due to slowly changing component values.

The improved process measurement system according to the invention relieves operating personnel of the burden of signal surveillance and reduces the probability of inadvertent process shut down due to faulted signals. The inventive arrangement only controls signal switching. It inserts no signal errors of its own. It is not active unless a signal fault occurs. The inventive arrangement is useful and can be implemented in connection with discrete solid state components and integrated circuits, microprocessors, or dedicated larged integrated circuits. It can be employed in any industry or system where redundant process measurements are desirable to increase the availability of signal channel instrumentation or control systems. With appropriate variations, the invention could be employed with two or more control signals, one of which is selected for control or a process point, are used for control of a process input.

The invention claimed is:

1. In a process measurement system of the type having a process data source and first and second signal generator means each operatively connected to the data source for generating first and second redundant signals, respectively, of the same process data, a first input channel connected to the first signal generator means, a second input channel connected to the second signal generator means, one output channel, and switch means operatively connected between the two input channels and one output channel for selectively connecting one of the input channels to the output channel, an improved system for detecting signal faults among the redundant signals comprising:

(a) a first comparator, means for transmitting the first and second redundant signals to the first comparator from the data source, the first comparator including means for comparing the first and second redundant signals for detecting whether the redundant signals fall within a predetermined first acceptance band and generating a first fault signal when at least one of the redundant signals falls outside of the first acceptance band, and selection logic means connected to said first comparator for generating an indicating signal responsive to the first fault signal;

(b) a second comparator connected directly to the first redundant signal transmitting means, a first delay means operatively interconnected between the first redundant signal transmitting means and the second comparator for generating a delayed first redundant signal, the second comparator including means for comparing the first redundant signal and the delayed first redundant signal for detecting whether the first redundant signal and delayed first redundant signal fall within a second predetermined acceptance band and generating a second fault signal when at least one of the first redundant signal and delayed first redundant signal falls outside of the second acceptance band, the selection logic means being operatively connected to the second comparator and including means for generating a first signal switching signal responsive to said second fault signal; and (c) a third comparator connected directly to the second redundant signal transmitting means, a second delay means operatively interconnected between the second redundant signal transmitting means and the third comparator for generating a delayed second redundant signal, the third comparator including means for comparing the second redundant signal an the delayed second redundant signal for detecting whether the second redundant signal and the delayed second redundant signal fall within a predetermined third acceptance band and generating a third fault signal when at least one of the second redundant signal and the delayed second redundant signal falls outside of the third acceptance band, the selection logic means being operatively connected to the third comparator and including means for generating a second signal switching signal responsive to the third fault signal.

2. In a process measurement system, as set forth in claim 1, the improved system wherein the selection logic means includes means for operating the switch means to connect the lock the first input channel to the output channel responsive to receipt of the first fault signal and the third fault signal.

3. In a process measurement system, as set forth in claim 2, the improved system wherein the selection logic means includes means for operating the switch means to connect and lock the second input channel to the output channel responsive to receipt of the first fault signal and the second fault signal.

4. In a process measurement system as set forth in claim 3, wherein the improved system further comprises a means operatively connected to the selection logic means for annunciating an alarm responsive to the indicating signal.

* * * * *